US006893389B1

(12) United States Patent
South et al.

(10) Patent No.: US 6,893,389 B1
(45) Date of Patent: May 17, 2005

(54) DISPOSABLE CENTRIFUGE WITH MOLDED GEAR DRIVE AND IMPULSE TURBINE

(75) Inventors: Kevin C. South, Cookeville, TN (US); Peter K. Herman, Cookeville, TN (US); Hendrik N. Amirkhanian, Cookeville, TN (US); Byron A. Pardue, Cookeville, TN (US)

(73) Assignee: Fleetguard, Inc., Nashville, TN (US)

( * ) Notice: Subject to any disclaimer, the term of this patent is extended or adjusted under 35 U.S.C. 154(b) by 232 days.

(21) Appl. No.: 10/255,367

(22) Filed: Sep. 26, 2002

(51) Int. Cl.[7] ..... B04B 9/06
(52) U.S. Cl. ..... 494/49; 494/84
(58) Field of Search ..... 494/23, 24, 36, 494/43, 49, 64, 65, 68–70, 83–84, 901; 210/168, 171, 232, 354, 360.1, 380.1, 416.5; 184/6.24

(56) References Cited

U.S. PATENT DOCUMENTS

| | | | | |
|---|---|---|---|---|
| 2,053,856 A | | 3/1936 | Weidenbacker | |
| 2,321,144 A | | 6/1943 | Jones | |
| 2,335,420 A | | 11/1943 | Jones | |
| 2,485,390 A | | 10/1949 | Langmuir | |
| 2,779,475 A | * | 1/1957 | Olcott | 127/19 |
| 2,973,896 A | | 3/1961 | Peltzer, Sr. | |
| 3,080,109 A | | 3/1963 | Halbach | |
| 3,273,324 A | | 9/1966 | Jennings | |
| 3,430,853 A | | 3/1969 | Kirk et al. | |
| 3,432,091 A | | 3/1969 | Beazley | |
| 3,784,092 A | | 1/1974 | Gibson | |
| 3,857,783 A | * | 12/1974 | Nishimura et al. | 210/138 |
| 3,879,294 A | | 4/1975 | Ellis et al. | |
| 4,106,689 A | | 8/1978 | Kozulla | |
| 4,221,323 A | | 9/1980 | Courtot | |
| 4,284,504 A | | 8/1981 | Alexander et al. | 210/168 |
| 4,288,030 A | | 9/1981 | Beazley et al. | |
| 4,346,009 A | | 8/1982 | Alexander et al. | 210/512.1 |

(Continued)

FOREIGN PATENT DOCUMENTS

| | | | | |
|---|---|---|---|---|
| GB | 784949 | | 4/1955 | |
| GB | 1465820 | * | 3/1977 | |
| GB | 2301122 A | | 9/1977 | 494/49 |
| GB | 2028689 | * | 3/1980 | |
| JP | 6-226142 | * | 8/1994 | |
| SU | 145089 | | 1/1962 | 494/49 |
| SU | 362643 | | 12/1972 | 494/49 |
| SU | 639607 | | 1/1977 | |
| SU | 564884 | | 7/1977 | 494/49 |
| SU | 869822 | | 10/1981 | 494/49 |
| SU | 1831375 | | 6/1991 | |
| WO | 99/56883 | * | 11/1999 | |
| WO | WO 01/03846 A1 | | 1/2001 | |
| WO | 02/34408 | * | 5/2002 | |

OTHER PUBLICATIONS

SAE Paper No. 971631, "Soot and Wear in Heavy Duty Diesel Engines", Robert Mainwaring International Spring Fuels & Lubricants Meeting, Dearborn, Michigan, May 5–8, 1997.

*Primary Examiner*—Charles E. Cooley
(74) *Attorney, Agent, or Firm*—Woodard, Emhardt, Moriarty, McNett & Henry LLP

(57) ABSTRACT

A centrifuge for separating particulate matter from a fluid includes a rotor assembly positioned within a centrifuge housing including a rotor housing. A driven gear is secured to a base portion of the rotor housing. A driving gear is integrally arranged with an impulse turbine. Rotary motion is imparted to the impulse turbine by a fluid stream from a jet nozzle. An alignment carrier provides a first post and spaced therefrom a second post, the first post including the jet nozzle. The driven gear is supported by the first post and the driving gear is assembled onto the second post. As fluid exits the nozzle under high pressure, it is directed at an annular ring of impulse turbine buckets, striking each bucket tangentially as the impulse turbine rotates.

30 Claims, 9 Drawing Sheets

U.S. PATENT DOCUMENTS

| | | | | | |
|---|---|---|---|---|---|
| 4,400,167 | A | | 8/1983 | Beazley et al. | 494/49 |
| 4,498,898 | A | | 2/1985 | Haggett | 494/49 |
| 4,508,530 | A | | 4/1985 | Schlegel et al. | 494/49 |
| 4,557,831 | A | | 12/1985 | Lindsay et al. | |
| 4,615,315 | A | | 10/1986 | Graham | |
| 4,731,545 | A | | 3/1988 | Lerner et al. | |
| 4,787,975 | A | | 11/1988 | Purvey | 210/360.1 |
| 4,950,130 | A | | 8/1990 | Erlach | |
| 5,096,581 | A | | 3/1992 | Purvey | 210/232 |
| 5,575,912 | A | | 11/1996 | Herman et al. | 210/380.1 |
| 5,637,217 | A | | 6/1997 | Herman et al. | 210/380.1 |
| 5,674,392 | A | | 10/1997 | Christophe et al. | 210/298 |
| 5,707,519 | A | | 1/1998 | Miller et al. | 210/354 |
| 5,779,618 | A | | 7/1998 | Onodera et al. | |
| 6,017,300 | A | | 1/2000 | Herman | |
| 6,019,717 | A | * | 2/2000 | Herman | 494/49 |
| 6,110,386 | A | * | 8/2000 | Underhill | 210/744 |
| 6,210,311 | B1 | * | 4/2001 | May | 494/24 |
| 6,213,929 | B1 | * | 4/2001 | May | 494/24 |
| 6,241,650 | B1 | * | 6/2001 | Letourneur | 494/11 |
| 6,296,765 | B1 | * | 10/2001 | Brown et al. | 210/380.1 |
| 6,334,841 | B1 | * | 1/2002 | Letourneur | 494/11 |
| 2001/0012814 | A1 | * | 8/2001 | May et al. | 494/24 |

* cited by examiner

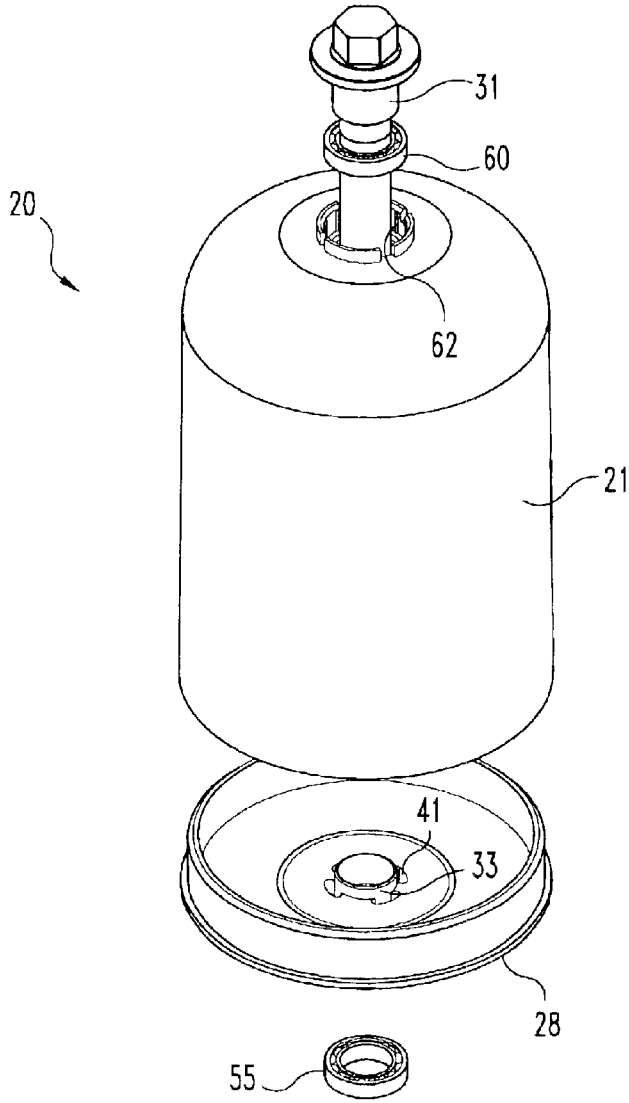
*Fig. 6*
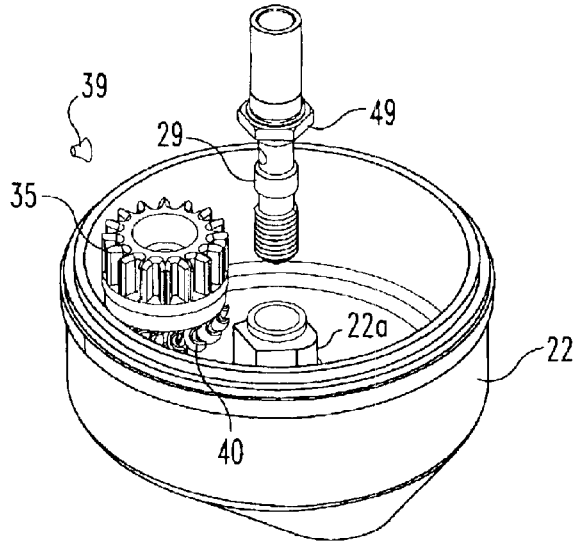

DISPOSABLE CENTRIFUGE WITH MOLDED GEAR DRIVE AND IMPULSE TURBINE

BACKGROUND OF THE INVENTION

The present invention relates in general to centrifuge designs for separating particulate matter out of a circulating fluid. Suitable particulate separation mechanisms for the present invention include spiral vane and cone-stack technologies, to name two of the possibilities. More specifically, the present invention relates to the use of an impulse turbine as a part of the overall drive mechanism that is used to impart rotary motion to the rotor assembly of the centrifuge. While a cone-stack or spiral vane particulate separation mechanism will preferably be positioned within the rotor shell as the preferred particulate separation means, the present invention is not limited by the type of particulate separation means which may be selected. The cone-stack and spiral vane styles of particulate separation means are believed to represent two of the more efficient arrangements and are selected for the preferred embodiment, in part, for this reason.

It is also helpful to understand the structure and functioning of one of the earlier centrifuge designs which uses an impulse turbine in cooperation with a particulate separation mechanism as part of the rotor design. One such earlier centrifuge design is disclosed in U.S. Pat. No. 6,017,300 which issued Jan. 25, 2000 to Herman. This '300 patent is expressly incorporated by reference herein for its disclosure and teaching of the overall centrifuge design and the use of a cone-stack subassembly as part of that centrifuge design. More specifically, the '300 patent discloses a cone-stack centrifuge which is designed for separating particulate matter out of a circulating liquid, using a cone-stack assembly. This cone-stack assembly is configured with a hollow rotor hub and is constructed to rotate about an axis. The cone-stack assembly is mounted onto a shaft centertube which is attached to a hollow base hub of a base assembly. The base assembly further includes a liquid inlet, a first passageway, and a second passageway which is connected to the first passageway. The liquid inlet is connected to the hollow base hub by the first passageway. A bearing arrangement is positioned between the rotor hub and the shaft centertube for rotary motion of the cone-stack assembly. An impulse-turbine wheel is attached to the rotor hub and a flow jet nozzle is positioned so as to be directed at the turbine wheel. The flow jet nozzle is coupled to the second passageway for directing a flow jet of liquid at the turbine wheel in order to impart rotary motion to the cone-stack assembly. The liquid for the flow jet nozzle enters the cone-stack centrifuge by way of the liquid inlet. The same liquid inlet also provides the liquid which is circulated through the cone-stack assembly for the separation of particulate matter.

The impulse-turbine wheel of the '300 patent is attached directly to the rotor hub and a driving fluid is used to impinge onto the open side of the buckets of the is impulse-turbine wheel. This driving fluid may either be a portion of the incoming fluid to be processed, typically oil, see FIGS. 1 and 1A of the '300 patent, or an auxiliary fluid, such as air, water, etc., see FIGS. 6 and 6A of the '300 patent. The bucket style may take on a variety of configurations, including the modified half bucket style and the conventional Pelton (split bucket) style, both of which are specifically disclosed in the '300 patent.

Having considered the design, construction, and operation of the apparatus of the '300 patent, it was recognized that improvements would be possible as part of the design of a fully disposable, molded plastic centrifuge rotor. One of the features of the present invention is the use of a gear drive to impart rotary motion to the rotor (assembly) of the centrifuge. One of the reasons for using gears to drive the centrifuge rotor is to be able to use different input mechanisms and increase or decrease the gear reduction or gearing ratio, thereby leading to slower or faster rates of rotation (RPMs) for the rotor (i.e., slower or faster centrifuges). Using gears not only increases the flexibility of the centrifuge design, but also allows for greater design freedom for selected other components, such as the bearings. When the centrifuge gear drive is combined with an impulse turbine, as disclosed by the present invention, the design freedom extends to the impulse turbine as well. The bearings and impulse turbine are both critical to the life and speed of the centrifuge package. Since the bearings are not disposable and are expensive, they need to last until the engine is overhauled. On smaller centrifugal units without gears, the outside diameter of the bearing drives the design of the impulse turbine which in turn limits performance and speed. The solution is to optimize the gear drive-impulse turbine relationship and the design of these individual component parts as part of the molded gear drive of the present invention.

The optimization of the present invention relates to the range of volumetric flow (gallons per minute (GPM)) that goes through the nozzle and is directed at the impulse turbine. With the volumetric flow rate set or selected, the next decision is to size the driven gear (arranged as part of the lower or bottom component of the rotor housing) for a given speed based on the customer's requirements. The gear ratio between the driving gear and the driven gear can be modified to include a broad range of speeds and applications.

Having a gear drive allows for another design challenge to be addressed. The direction of the nozzle is critical to the speed of the centrifuge. Using the gear drive allows for the nozzle and impulse (Pelton) turbine to be placed on an alignment carrier which takes care of any manufacturing alignment issues. This particular design of the present invention enables preselection of an optimum gear ratio for proper turbine performance at the target rotor speed. Having the impulse (Pelton) turbine separate from the rotor assembly prevents the disposal of the expensive impulse (Pelton) turbine at the time of the disposal of the rotor assembly.

SUMMARY OF THE INVENTION

A centrifuge for separating particulate matter from a fluid according to one embodiment of the present invention comprises a rotor assembly including a rotor housing, a driven gear secured to the rotor housing, an impulse turbine, a driving gear secured to the impulse turbine, and an alignment carrier including a first post and spaced therefrom a second post, the first post including a jet nozzle directed at the second post and constructed and arranged in flow communication with the rotor assembly wherein the driving gear is mounted onto the second post and the driven gear is supported by the first post such that the driving gear meshes with the driven gear for rotation of the rotor assembly.

One object of the present invention is to provide an improved impulse turbine centrifuge for separating particulate matter from a fluid.

Related objects and advantages of the present invention will be apparent from the following description.

BRIEF DESCRIPTION OF THE DRAWINGS

FIG. 6 is an exploded, perspective view of the FIG. 3 centrifuge.

DESCRIPTION OF THE PREFERRED EMBODIMENT

Figure 1:
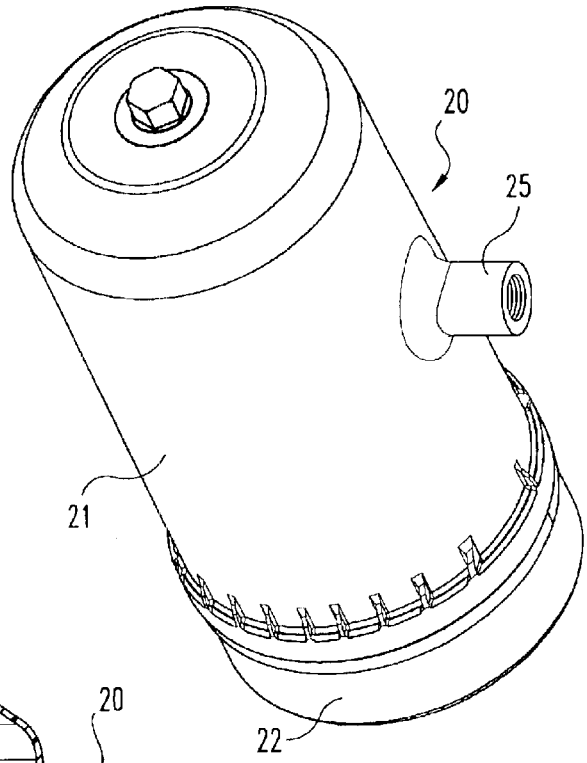
FIG. 1 is a perspective view of a centrifuge according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
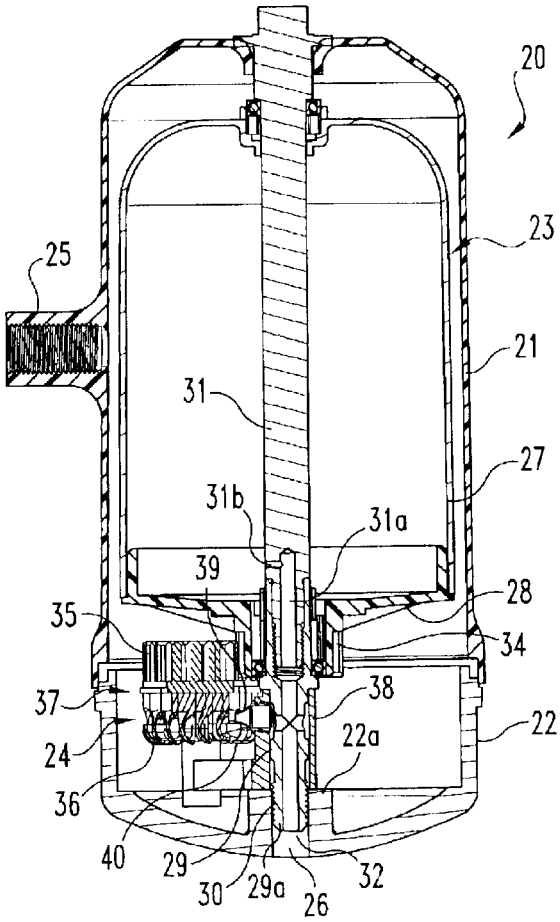
FIG. 2 is a front elevational view, in full section, of the FIG. 1 centrifuge as would be viewed along line 2—2 in FIGS. 3A and 5A.

Referring to FIGS. 1 and 2, there is illustrated a centrifuge 20 which includes a centrifuge housing configured with an upper housing portion 21 and a lower housing portion 22 which are securely joined together so as to define a liquid-tight enclosure. Also included as part of centrifuge 20 is a rotor assembly 23, which is assembled into the interior of the centrifuge housing, and a rotary drive mechanism 24. The upper housing portion 21 includes an internally-threaded fitting 25 for insertion of a sensor. The fluid (oil) inlet 26 is positioned in the centrifuge housing near the geometric center. The rotor assembly 23 includes a rotor housing configured with an upper rotor housing portion 27 and a lower rotor housing base 28 which are securely joined together so as to define a liquid-tight enclosure. A shaft adapter 29 is threaded into an internally-threaded hole 30 in the lower housing portion 22. A rotor assembly shaft 31 is threaded into shaft adapter 29. Shaft 31 actually extends through the geometric center of the rotor assembly 23 which is concentrically positioned inside of the centrifuge housing.

Figure 2A:
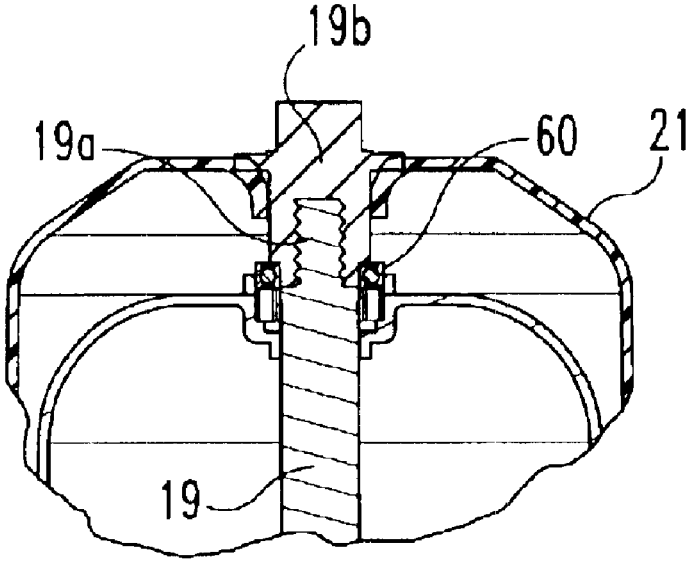
FIG. 2A is a partial, front elevational view, in full section, of an alternate design for a portion of the preferred embodiment, according to the present invention.

In FIG. 2A an alternative construction is illustrated for the shaft 31 and shaft adapter 29 threaded combination. Instead of the threaded assembly of the shaft 31 into the shaft adapter 29, this alternate construction for the preferred embodiment utilizes a unitary shaft member 19, the upper portion of which is illustrated in FIG. 2A. It should be understood that all structural aspects and features of shaft member 19 are the same as what would be provided by the combination of shaft 31 and shaft adapter 29, except the threaded assembly of those two components is now replaced by the unitary shaft member. A further difference involves the reconfiguring of the upper portion of shaft member 19 which is different from that illustrated for shaft 31 (see FIG. 2), as shaft 31 extends through the rotor housing at the location of the upper ball bearing 60. As illustrated in FIG. 2A, shaft member 19 includes a reduced diameter, externally-threaded end 19*a* which is threadedly received by shaft nut 19*b*. This alternate construction for the shaft 31 and shaft adapter 29 combination enables the upper ball bearing 60 to be preassembled (press-fit) onto the shaft nut 19*b*.

With continued reference to FIGS. 1 and 2, the hollow interior of lower housing portion 22 provides a clearance volume for the rotary drive mechanism 24 and a location for a fluid drain opening. The raised boss 22*a* which helps define hole 30 also helps define fluid inlet 26. It will also be noted that shaft adapter 29 is hollow. By leaving a clearance space 32 between the lower end 29*a* of shaft adapter 29 and the bottom edge of hole 30, it is possible to use a variety of fitting styles or configurations to introduce fluid (oil) into centrifuge 20. Shaft 31 defines a lower hollow portion 31*a* which is in fluid flow communication with the hollow interior of shaft adapter 29. The hollow portion 31*a* is in fluid flow communication with the interior of a rotor centertube (not illustrated) via metered or throttle orifice flow outlet 31*b*. The flow of oil into an annular clearance space between the centertube and shaft 31 travels to the upper area of the rotor housing. Outlet 31*b* is specifically designed with a reduced diameter size compared to the flow area of hollow portion 31*a*. The effect of this specific flow sizing is to limit the flow through and reduce the fluid pressure entering the rotor. The reference to "throttle orifice" flow outlet 31*b* is intended to help convey an understanding of the function of this design for outlet 31*b*. One of the benefits of the lower pressure is to be able to design the rotor with thinner walls. Another benefit is to be able to reduce the risk of blowing open the seal at the lower bearing location.

Figure 9:
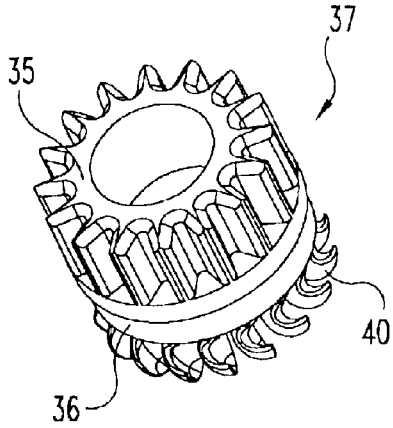
FIG. 9 is a perspective view of an impulse turbine/driving gear combination comprising one portion of the FIG. 1 centrifuge.
Figure 10:
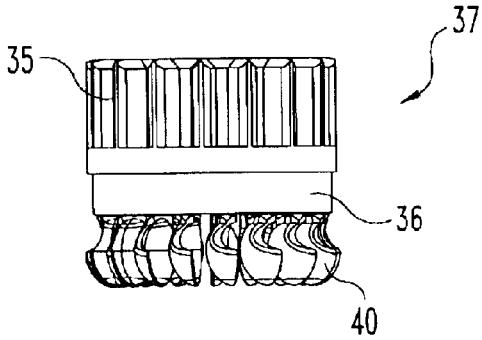
FIG. 10 is a front elevational view of the FIG. 9 combination.

Rotary driven mechanism 24 includes a molded driven gear 34 which is secured to base 28, a molded driving gear 35, and a molded impulse turbine 36. The driving gear 35 and impulse turbine 36 are secured together into an integral combination 37 (see FIGS. 9 and 10). In lieu of being molded, the driving gear 35 and impulse turbine can be cast. As used herein, "secured" is intended to include a variety of arrangements such as an integrally molded (unitary) combination, as in the case of gear 34 and base 28, as well as a press fit arrangement, splined, or spin welded as would all be suitable in the case of gear 35 and impulse turbine 36, to name a few of the options. An alignment carrier 38, also a part of the rotary driven mechanism 24, is assembled to shaft adapter 29 and fits into combination 37 so as to enable rotary motion of the combination 37. A nozzle 39 is assembled into carrier 38 in order to direct a jet stream of fluid at the peripheral buckets 40 of impulse turbine 36.

A selected separation mechanism (not illustrated) is to be positioned within the rotor housing for separating particular matter from a flow of liquid which is being processed by centrifuge 20. While the preferred particulate separation mechanism for the subject invention is a cone-stack or spiral vane subassembly, the focus of the present invention is on the rotary driving arrangement to impart rotary motion to the rotor assembly 23 so that is can achieve the requisite RPM speed for efficient particulate separation. The flow of oil up through the centertube exits near the top of the centertube for processing by the selected separation mechanism.

Figure 11:
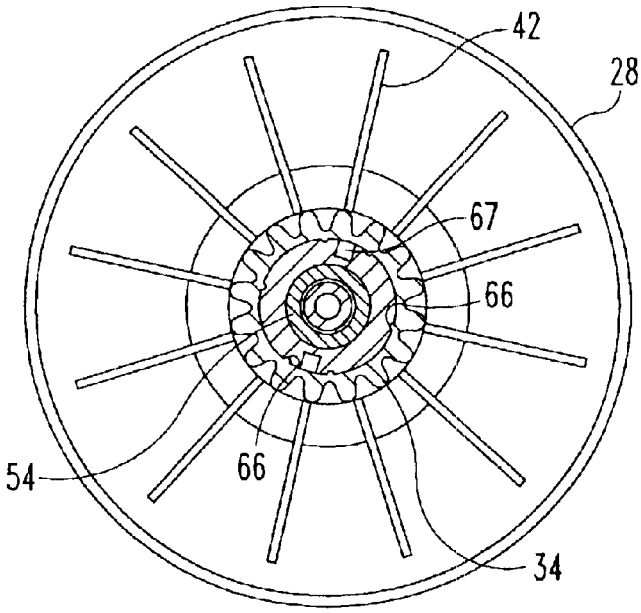
FIG. 11 is a diagrammatic, bottom plan view with a driven gear/bearing combination in full section.
Figure 12:
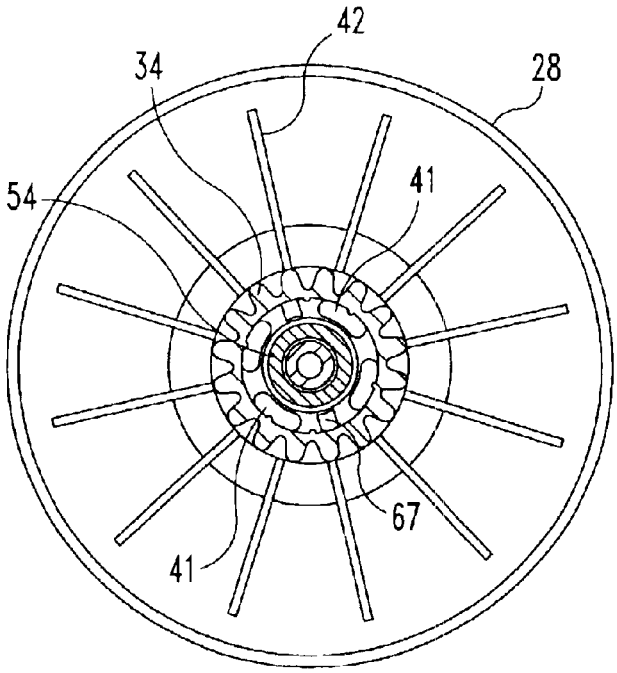
FIG. 12 is a diagrammatic, bottom plan view with a driven gear/bearing combination in full section.

The fluid flow path through centrifuge 20 begins with fluid inlet 26. The fluid to be processed by centrifuge 20 enters inlet 26 at a designed pressure and flow rate. Assuming a steady-state operating condition rather than initial startup or shut down, the incoming flow travels through inlet 26 into shaft adapter 29. A portion of this flow is allowed to exit via nozzle 39 which creates a jet stream flow directed at the buckets 40 of impulse turbine 36. The remainder of the fluid flow through shaft adapter 29 flows up through the hollow portion 31*a* of shaft 31. This flow exits into the interior of the centertube via metered or throttle orifice flow outlet 31*b*. The fluid is routed to the upper area of the rotor housing and then processed by the selected particulate separation means for the rotor assembly 23. After processing, the fluid is allowed to exit the rotor assembly by way of flow exit passageways 41 defined by and positioned between gear 34 and sleeve 33. Additional exit flow passageways 44 are defined by and positioned between gear hub 55 and bearing 54, see FIGS. 11 and 12. The fluid flow is then able to leave the centrifuge 20 by way of drain opening 22*c* defined by lower housing portion 22, see FIG. 3A. The centertube is assembled onto sleeve 33.

Figure 3:
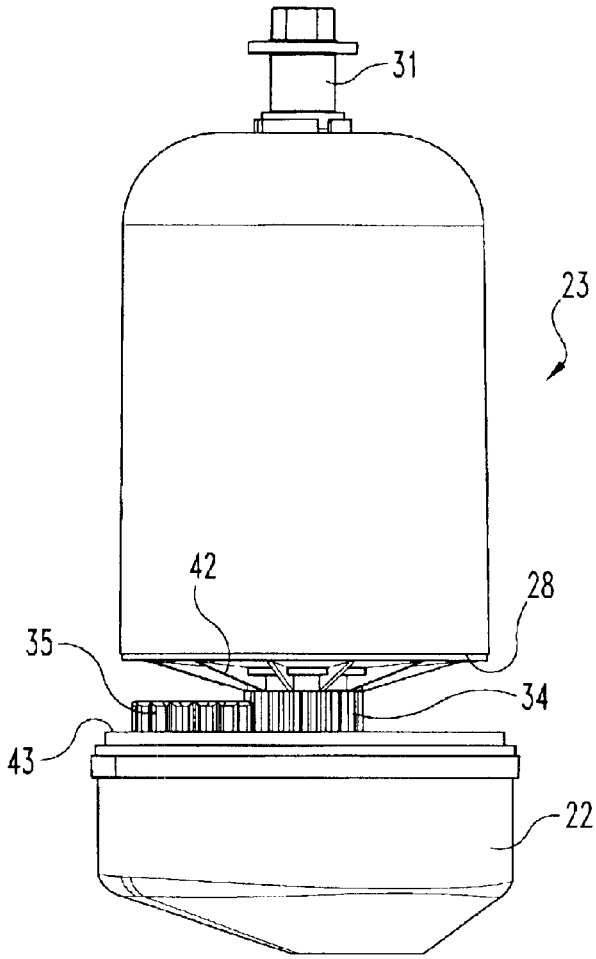
FIG. 3 is a front elevational view of the FIG. 1 centrifuge with the upper housing portion of the centrifuge removed.
Figure 3A:
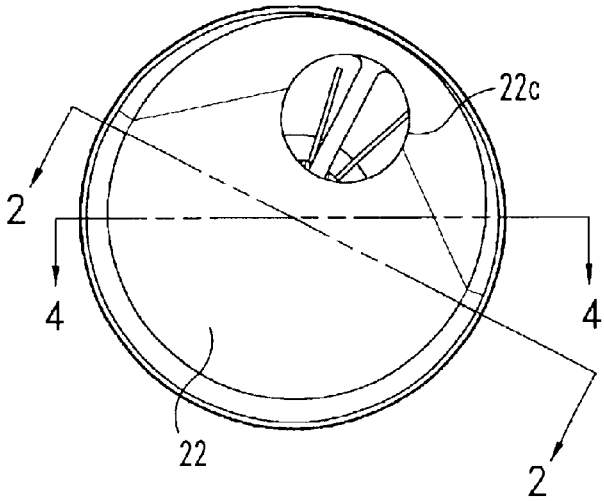
FIG. 3A is a bottom plan view of the FIG. 3 centrifuge.
Figure 4:
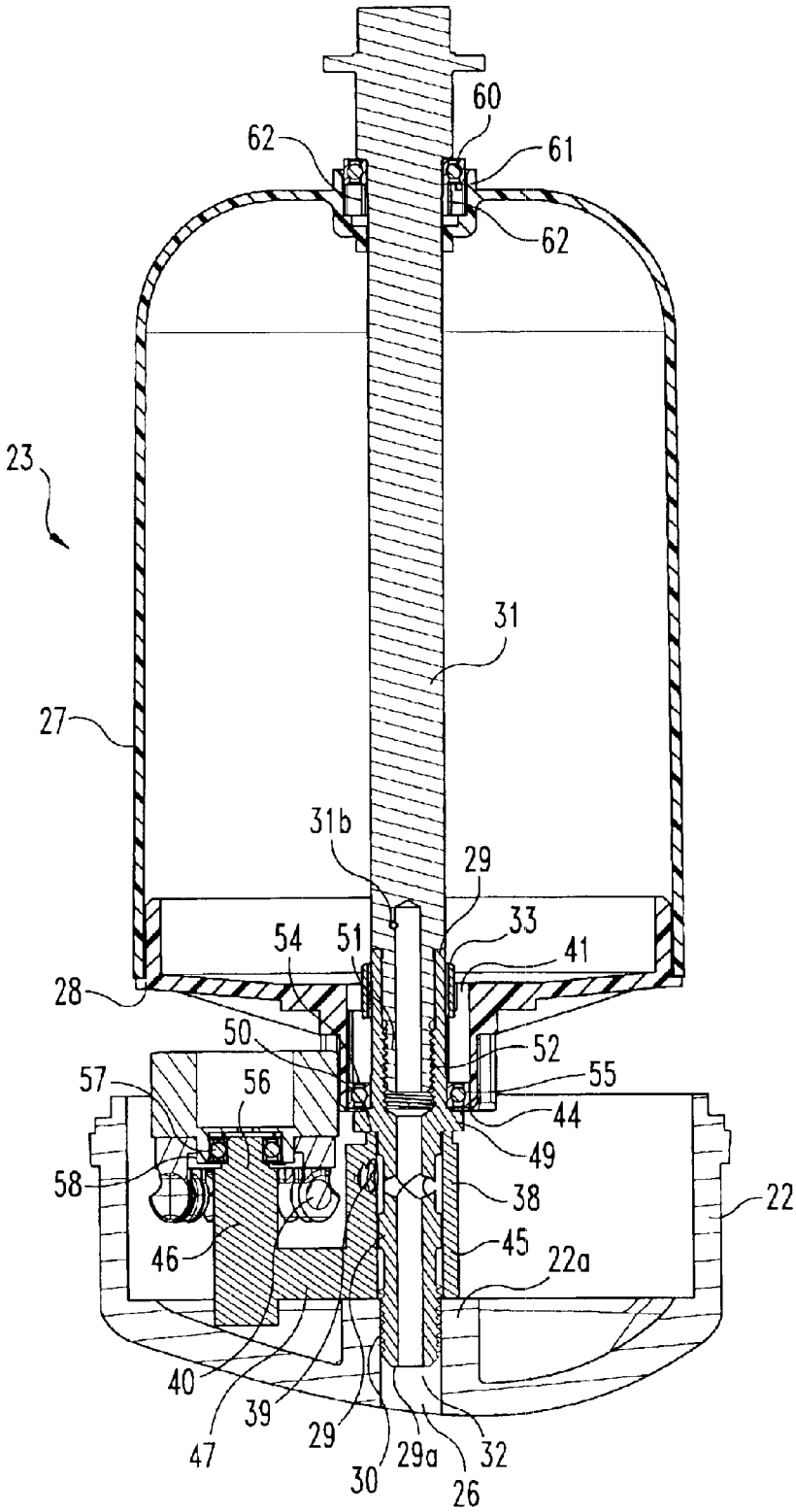
FIG. 4 is an enlarged, front elevational view, in full section, of the FIG. 3 centrifuge as would be viewed along line 4—4 in FIGS. 3A and 5A.
Figure 5:
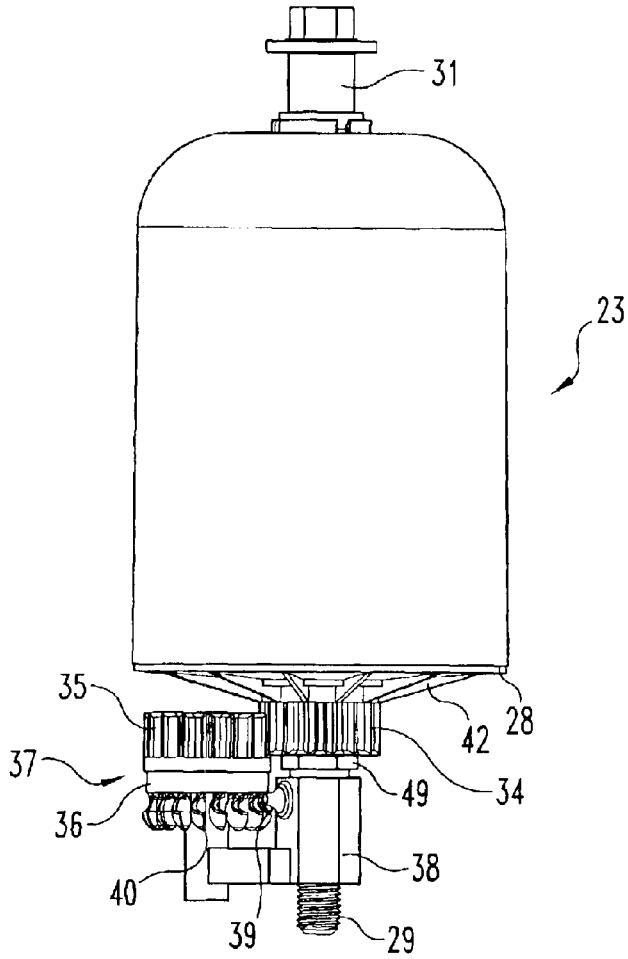
FIG. 5 is a front elevational view of the FIG. 3 centrifuge with the lower housing portion of the centrifuge removed.
Figure 5A:
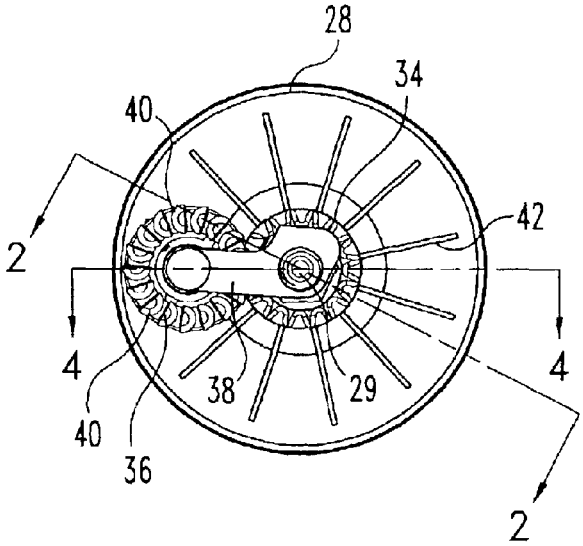
FIG. 5A is a bottom plan view of the FIG. 5 centrifuge.

Referring to FIGS. 3, 3A and 4, the rotor assembly 23, with the upper housing portion 21 removed, is illustrated. The front elevational view of FIG. 3 and the full section view of FIG. 4 show the configuration of the lower rotor housing base 28 including the frustoconical webs 42 and the spatial location and arrangement of driven gear 34. The bottom plan view of FIG. 3A illustrates the drain opening 22*c* in the lower housing portion 22. The rotary driven mechanism 24 is substantially contained within the lower housing portion 22, as is illustrated. The driving gear 35 extends above upper edge 43 of portion 22. The cooperating mesh between gear 34 and gear 35 is also illustrated.

As is best illustrated in FIGS. 2, 4, 5, 5A and 8, the assembly and functioning of rotary drive mechanism 24 begins with shaft adapter 29 being securely and tightly threaded into hole 30. Hole 30 is defined by boss 22*a* which also serves as an abutment surface for alignment carrier 38. The alignment carrier 38, which in the preferred embodiment is a unitary molded member, includes a first support post arranged as an adapter sleeve 45, support post 46, and connecting arm 47 which extends between sleeve 45 and post 46. Alternative unitary construction methods for alignment carrier 38 include casting, machining, and forging, among others. As will be explained, sleeve 45 supports the driven gear 34 (via shaft adapter 29) such that the gears properly mesh. The nozzle 39 inserted into sleeve 45 is generally directed at post 46, but specifically directed at the buckets 40 of impulse turbine 36. In the assembly of the various components, the shaft adapter 29 is inserted into and through sleeve 45 and then lower end 29*a* is threaded into hole 30. Hex flange 49 of adapter 29 is used to tighten the threaded end 29*a* into hole 30 and additionally clamps against the upper surface 50 of sleeve 45. The threaded end 51 of shaft 31 threads into the internally-threaded hole 52 of adapter 29.

A first ball bearing 54 is positioned adjacent the upper surface of hex flange 49 between the hollow hub 55 of driven gear 34 and shaft adapter 29. A second ball bearing 60 is positioned between rotor housing hub 61 and shaft 31. This rotor, shaft and ball bearing arrangement allows the rotor assembly 23 to rotate at a high RPM for particulate separation while the shaft 31, shaft adapter 29, and the two centrifuge housing portions remain stationary. In order to impart rotary motion to driven gear 34, driving gear 35 is rotated by directing a high speed fluid jet from nozzle 39 along a tangential line that intersects the approximate center of each bucket 40. Each bucket has a concave surface side which is directed at the nozzle 39 and thus is directed at the fluid jet stream exiting from nozzle 39. The impulse turbine 36 rotates such that each bucket 40 is sequentially moved into a tangent line for impingement by the jet stream. This impinging force causes the turbine to rotate (faster) and presents the next bucket in sequence for impingement. Since the integral combination 37 of driving gear 35 and impulse turbine 36 moves as a single component, the rotation of the impulse turbine rotates the driving gear 35 which is meshed with driven gear 34. Support post 46 has a reduced diameter neck portion 56 which fits into shielded ball bearing 57 which in turn is fitted into the hollow hub 58 of driving gear 35. While the impulse turbine 36 and driving gear 35 are secured together into an integral combination, these two components are also keyed together so as to accurately transmit the torque and rotary motion of the impulse turbine 36 to the driving gear 35, without slippage.

Figure 7:
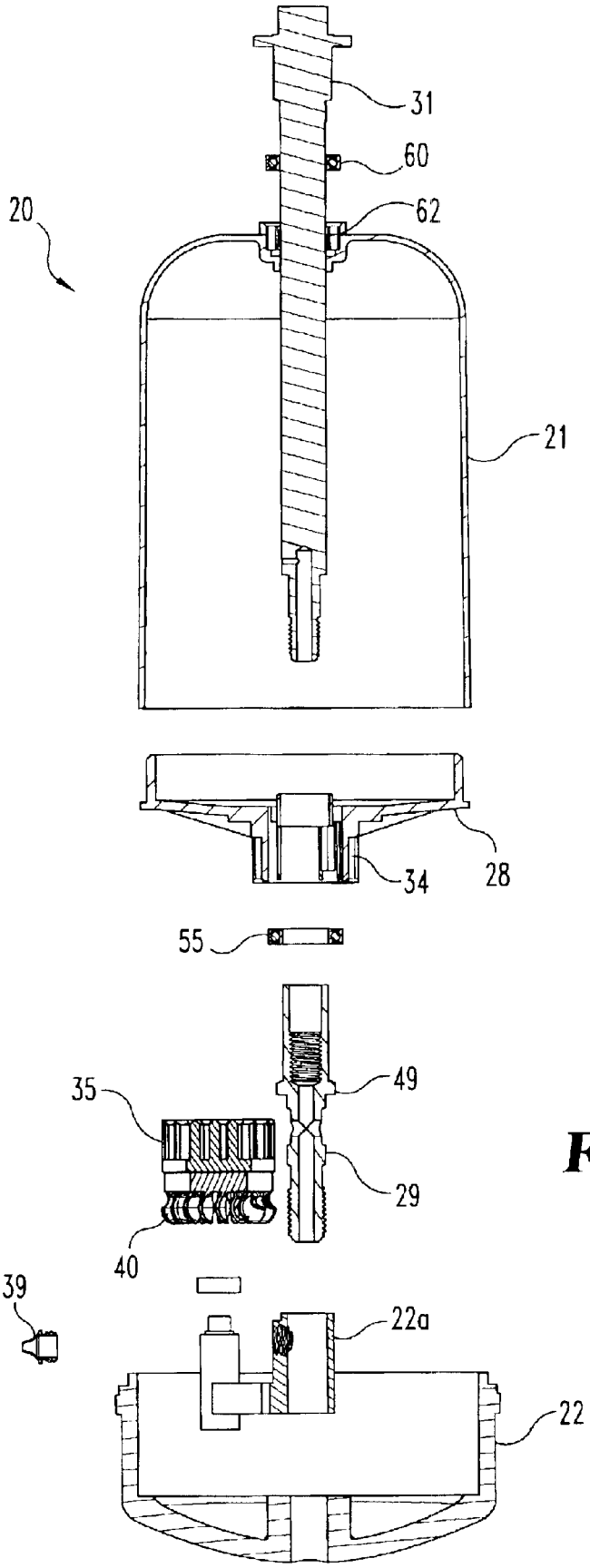
FIG. 7 is an exploded, front elevational view, in full section, of the FIG. 3 centrifuge as would be viewed along line 2—2 in FIGS. 3A and 5A.
Figure 8:
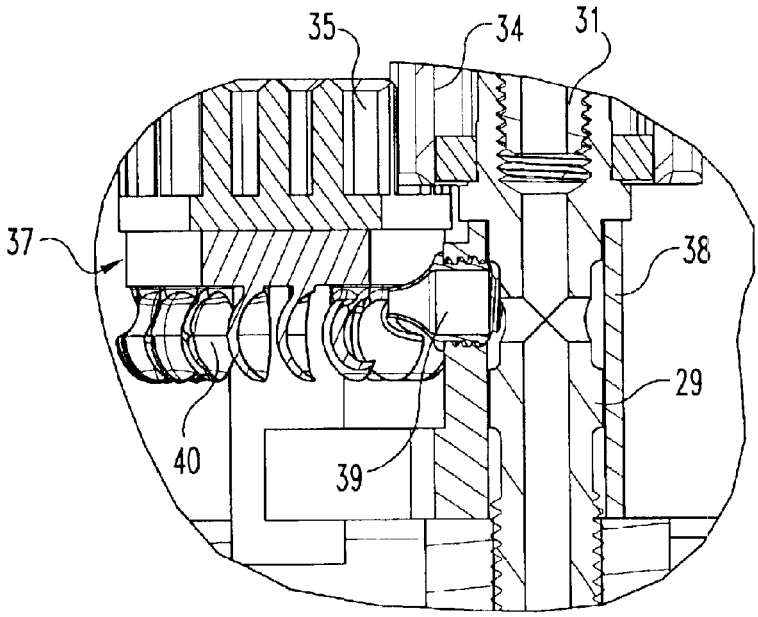
FIG. 8 is an enlarged, partial, front elevational view, in full section, of a portion of the FIG. 2 centrifuge.

Referring to FIGS. 6 and 7, the overall centrifuge assembly is illustrated, including the rotor assembly 23, the centrifuge lower housing portion 22, and the rotary driven mechanism, though excluding the upper housing portion 21.

With continued reference to FIGS. 2, 4, 11, and 12, it should be understood that the upper or second ball bearing 60 is pressed into the inside diameter of hub 61. The upper rotor housing portion 27 is a unitary, molded plastic member and hub 61 is shaped with a series of six axially-extending, equally-spaced raised ribs 62. Each rib extends radially inwardly a distance of approximately 0.032 inches.

By sizing the hub 61 (excluding the ribs 62) for a slight press fit with bearing 60, insertion of the bearing 60 down into hub 61 causes a "crushing" of the upper portions of ribs 62 as these portions of the ribs are contacted by bearing 60. Due to this crushing of these molded plastic ribs 62, these ribs can be referred to as "crush ribs". The effect of this crushing is to achieve an added degree of interference between the bearing and the hub and thus added holding security in order to maintain the bearing 60 in position. A pair of oppositely-disposed, molded abutment tabs, as part of hub 61, serve to limit the axial depth of insertion of bearing 60 down into hub 61. While these abutment tabs for the upper bearing 60 are likely difficult to discern from the drawing illustrations, similar abutment tabs are used for the lower bearing and these can be seen in FIGS. 11 and 12. Due to the similarity between the use of crush ribs and abutment tabs for both upper and lower ball bearings, the illustration of these abutment tabs in conjunction with the lower ball bearing should suffice for an adequate understanding of the assembly technique for the upper ball bearing.

At the opposite end of shaft 31, bearing 54 is mounted into the gear hub in a similar manner as what has been described for upper ball bearing 60. The lower rotor housing portion 28 is a unitary, molded plastic member, including gear 34. The hub 55 of gear 34 is also arranged with a series of equally-spaced crush ribs 66. In this case, the diameter sizes selected for the bearing 54, hub 55, and ribs 66 is such that the bearing has a slight interference fit against the ribs 66. While there may be some slight crushing of the radially innermost surfaces of the ribs 66, these ribs are not completely crushed so as to draw the outer surface of the bearing into contact with the inner surface of the hub. Consequently, the previously identified exit flow passageways 44 are created in an alternating pattern or series with ribs 66. Between each pair of adjacent ribs 66 there is one exit flow passageway 44 whose remaining boundaries are defined by hub 55 and bearing 54. These exit flow passageways 44 are positioned between hub 55 and bearing 54 and provide an exit flow path for the processed fluid (oil) from the interior of the rotor assembly to the drain location. The aforementioned pair of abutment tabs 67 are used to control the depth of insertion of bearing 54 into hub 55.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A centrifuge for separating particulate matter from a fluid, said centrifuge comprising:

a rotor assembly including a rotor housing;

a driven gear secured to said rotor housing;

an impulse turbine;

a driving gear secured to said impulse turbine; and an alignment carrier including a first post and spaced therefrom a second post, said first post including a jet nozzle and being constructed and arranged in flow communication with said rotor assembly, wherein said driving gear is mounted onto said second post and said driven gear is supported by said first post and said jet nozzle is directed toward said impulse turbine such that said driving gear meshes with said driven gear for rotation of said rotor assembly.

2. The centrifuge of claim 1 wherein said alignment carrier is a unitary member.

3. The centrifuge of claim 2 wherein said impulse turbine is a unitary member.

4. The centrifuge of claim 3 which further comprises a centrifuge housing including a lower housing portion defining a hollow interior, said alignment carrier being positioned within said hollow interior.

5. The centrifuge of claim 4 which further comprises a shaft adapter which is assembled into said lower housing portion.

6. The centrifuge of claim 5 wherein said first post is received on said shaft adapter.

7. The centrifuge of claim 6 wherein said shaft adapter defines a hollow interior which is in flow communication with said nozzle.

8. The centrifuge of claim 7 which further comprises a shaft which is assembled into said shaft adapter and extends through said rotor assembly.

9. The centrifuge of claim 8 which further comprises bearing means positioned between said shaft and said rotor housing.

10. The centrifuge of claim 9 which further comprises a bearing positioned between said second post and said driving gear.

11. The centrifuge of claim 10 wherein said rotor housing includes a lower rotor housing base and said driven gear being molded as part of said lower rotor housing base as a unitary combination.

12. The centrifuge of claim 11 wherein said impulse turbine includes an annular array of buckets, each bucket opening toward said nozzle when rotated into alignment with said nozzle.

13. The centrifuge of claim 1 wherein said impulse turbine is a unitary member.

14. The centrifuge of claim 13 wherein said impulse turbine includes an annular array of buckets, each bucket opening toward said nozzle when rotated into alignment with said nozzle.

15. The centrifuge of claim 14 which further comprises a centrifuge housing including a lower housing portion defining a hollow interior, said alignment carrier being positioned within said hollow interior.

16. The centrifuge of claim 15 which further comprises a shaft adapter which is assembled into said lower housing portion.

17. The centrifuge of claim 16 wherein said first post is received on said shaft adapter.

18. The centrifuge of claim 1 which further comprises a centrifuge housing including a lower housing portion defining a hollow interior, said alignment carrier being positioned within said hollow interior.

19. The centrifuge of claim 18 which further comprises a shaft adapter which is assembled into said lower housing portion.

20. The centrifuge of claim 19 wherein said first post is received on said shaft adapter.

21. The centrifuge of claim 20 wherein said shaft adapter defines a hollow interior which is in flow communication with said nozzle.

22. The centrifuge of claim 1 which further comprises a centrifuge housing including a lower housing portion, a shaft adapter being assembled into said lower housing portion.

23. The centrifuge of claim 22 wherein said first post is received on said shaft adapter.

24. The centrifuge of claim 23 wherein said shaft adapter defines a hollow interior which is in flow communication with said nozzle.

25. The centrifuge of claim 1 wherein said rotor housing includes a lower rotor housing base and said driven gear being molded as part of said lower rotor housing base as a unitary combination.

26. The centrifuge of claim 25 wherein said impulse turbine includes an annular array of buckets, each bucket opening toward said nozzle when rotated into alignment with said nozzle.

27. The centrifuge of claim 1 wherein said driven gear includes a hollow hub constructed and arranged with crush ribs.

28. The centrifuge of claim 27 which further includes bearing means received by said driven gear hollow hub, said crush ribs being constructed and arranged to be deformed by said bearing means.

29. The centrifuge of claim 1 wherein said rotor housing includes an upper housing portion with a receiving hub constructed and arranged with crush ribs.

30. The centrifuge of claim 29 which further includes bearing means received by said receiving hub, said crush ribs being constructed and arranged to be deformed by said bearing means.

* * * * *

UNITED STATES PATENT AND TRADEMARK OFFICE

CERTIFICATE OF CORRECTION

PATENT NO. : 6,893,389 B1
DATED : May 17, 2005
INVENTOR(S) : South et al.

It is certified that error appears in the above-identified patent and that said Letters Patent is hereby corrected as shown below:

Column 1,
Line 57, delete "is" between "the" and "impulse-".

Signed and Sealed this

Ninth Day of August, 2005

JON W. DUDAS
*Director of the United States Patent and Trademark Office*